US011306462B2

(12) United States Patent
Casciano

(10) Patent No.: US 11,306,462 B2
(45) Date of Patent: Apr. 19, 2022

(54) COLLECTION TANK FOR SUMP PUMP UNDER BUILDING FLOOR

(71) Applicant: Lyon Holdings Ltd., Winnipeg (CA)

(72) Inventor: Paul Casciano, Winnipeg (CA)

(73) Assignee: Lyon Holdings Ltd., Winnipeg (CA)

( * ) Notice: Subject to any disclaimer, the term of this patent is extended or adjusted under 35 U.S.C. 154(b) by 0 days.

(21) Appl. No.: 16/998,483

(22) Filed: Aug. 20, 2020

(65) Prior Publication Data

US 2021/0054602 A1 Feb. 25, 2021

Related U.S. Application Data

(60) Provisional application No. 62/890,356, filed on Aug. 22, 2019.

(51) Int. Cl.
*E03B 3/06* (2006.01)
*E02B 11/00* (2006.01)

(52) U.S. Cl.
CPC ..... *E03B 3/06* (2013.01); *E02B 11/00* (2013.01)

(58) Field of Classification Search
CPC ..... E03B 5/02; E03B 3/06; E02B 11/00
See application file for complete search history.

(56) References Cited

U.S. PATENT DOCUMENTS 2,767,801 A * 10/1956 Eads ..... C02F 3/046 210/170.08
3,579,995 A * 5/1971 Flynn ..... E03F 1/002 405/46
3,645,100 A * 2/1972 La Monica ..... E02B 13/00 405/46
4,031,009 A * 6/1977 Hicks ..... E03F 1/002 210/164
4,988,235 A * 1/1991 Hurley ..... E02D 3/10 405/50
2012/0107047 A1* 5/2012 Wynne ..... E03F 1/002 405/44
2019/0169830 A1* 6/2019 Jurgens et al. ..... E21B 7/046

* cited by examiner

*Primary Examiner* — Tara Mayo-Pinnock
(74) *Attorney, Agent, or Firm* — Ryan W. Dupuis; Kyle R. Satterthwaite; Ade & Company Inc.

(57) ABSTRACT

A collection tank for mounting in a bed of gravel particles under a floor of a building for collecting ground water from an area under the floor has a tank body including a lower tank portion and an upper tank portion. The lower tank portion defines a container for collected water with an open top. The upper tank portion has an outer wall upstanding from the open top of the lower tank portion, in which the outer wall is perforated with holes for passage of ground water into the tank body. Each of the holes extends radially through the outer wall of the upper tank portion at an upward slope so as to minimize entry of surrounding gravel particles into the tank body through the holes.

13 Claims, 4 Drawing Sheets

COLLECTION TANK FOR SUMP PUMP UNDER BUILDING FLOOR

This application claims the benefit under 35 U.S.C. 119 (e) of U.S. provisional application Ser. No. 62/890,356, filed Aug. 22, 2019.

FIELD OF THE INVENTION

The present invention relates to collection tank placed under a floor of a building to collect water from an area under the floor and which is capable of receiving a sump pump to pump the collected water from the collection tank away from the building.

BACKGROUND

A common arrangement for a building is to provide a series of weeping tiles in the form of perforated drainage piping about the perimeter and below the floor of the building which collect groundwater and direct the groundwater into a sump pit. A typical sump pit comprises a collection tank mounted in the ground below the floor of the building in connection with the weeping tile to collect water from the perimeter and below the floor of the building into the collection tank. A sump pump is mounted in the collection tank for pumping collected water through a discharge hose to a discharge location away from the building. The collection tank is typically perforated to allow surrounding groundwater to enter into the collection tank. To ensure adequate drainage through the ground below the floor, the ground is typically first excavated and filled with an aggregate material such as gravel which receives the collection tank therein below the floor of the building such that water flows through the spaces between the gravel particles and into the perforations in the walls of the collection tank for subsequent collection and pumping by the sump pump. Commonly used gravel below the floor of a building includes a particle size which may be smaller than the perforated holes in the walls of the collection tank such that some of the gravel particles may also pass through the holes into the interior of the collection tank in a manner which may interfere with effective operation of the sump pump.

SUMMARY OF THE INVENTION

According to one aspect of the invention there is provided a collection tank for mounting under a floor of a building for collecting ground water from an area under the floor comprising:

a tank body including a lower tank portion and an upper tank portion;

the lower tank portion having a bottom wall and an outer wall upstanding from the bottom wall, the outer wall and the bottom wall of the lower tank portion defining a container for collected water with an open top;

the upper tank portion having a bottom edge connected to the lower tank portion at the open top and having an outer wall upstanding from the open top, the outer wall of the upper tank portion being perforated with holes arranged in an array extending around a full periphery of the outer wall of the upper tank portion for passage of ground water through the array of holes into the tank body;

the upper tank portion having an open bottom for communication of the ground water into the lower reservoir portion;

the lower tank portion being arranged to receive the pump so as to pump water from the lower tank portion at a position below the open top of the lower tank portion and below the holes in the upper tank portion;

each of the holes extending radially through the outer wall of the upper tank portion from an outer perimeter edge at an intersection of the hole with an outer surface of the outer wall at an exterior of the tank body to an inner perimeter edge at an intersection of the hole with an inner surface of the outer wall at an interior of the tank body; and each of the holes having a lowermost portion of the inner perimeter edge of the hole being at a greater height from the bottom wall than a lowermost portion of the outer perimeter edge of the hole.

By arranging each hole so that the inner peripheral edge of the hole is elevated at the lowermost point thereof relative to the lowermost point of the outer peripheral edge of the hole, each hole is effectively inclined upwardly and inwardly from the exterior to the interior of the tank. This allows water to readily pass through the hole while preventing gravel particles from readily passing through the hole to minimize the collection of gravel particles within the collection tank.

Preferably each hole is arranged such that the lowermost portion of the inner perimeter edge of the hole is at a greater height from the bottom wall than an intersection of an angle of repose of a granular material extending from an uppermost edge of the outer perimeter edge of the hole with the inner surface of the outer wall.

Preferably the tank is used with granular material having an average particle size that is smaller than a diameter of the holes.

Preferably each hole has a hole diameter that is between ¼ inch and ⅜ inch.

Preferably the outer wall of the upper tank portion has a wall thickness that is 0.1 and 0.2 inches.

Preferably each hole extends radially inward from the outer surface of the outer wall to the inner surface of the outer wall at an upward inclination. The upward inclination may be at least 35 degrees from horizontal and more preferably is at least 45 degree from horizontal. In addition, the upward inclination may be less than 55 degrees from horizontal and more preferably is less than 50 degrees from horizontal.

BRIEF DESCRIPTION OF THE DRAWINGS

Some embodiments of the invention will now be described in conjunction with the accompanying drawings in which.

In the drawings like characters of reference indicate corresponding parts in the different figures.

DETAILED DESCRIPTION

Figure 1:
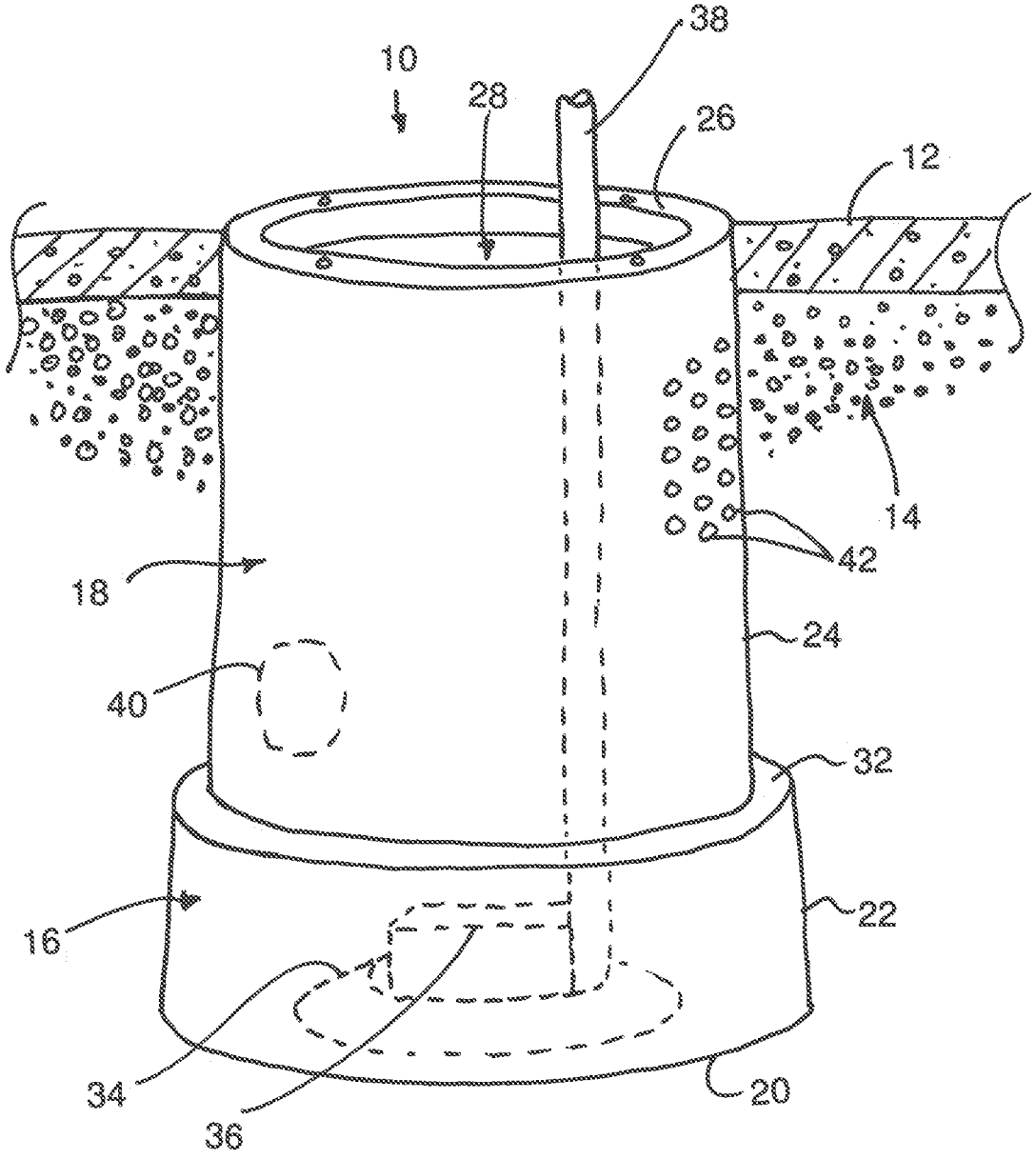
FIG. 1 is a perspective view of a first embodiment of the collection tank with the cover plate removed therefrom.
Figure 2:
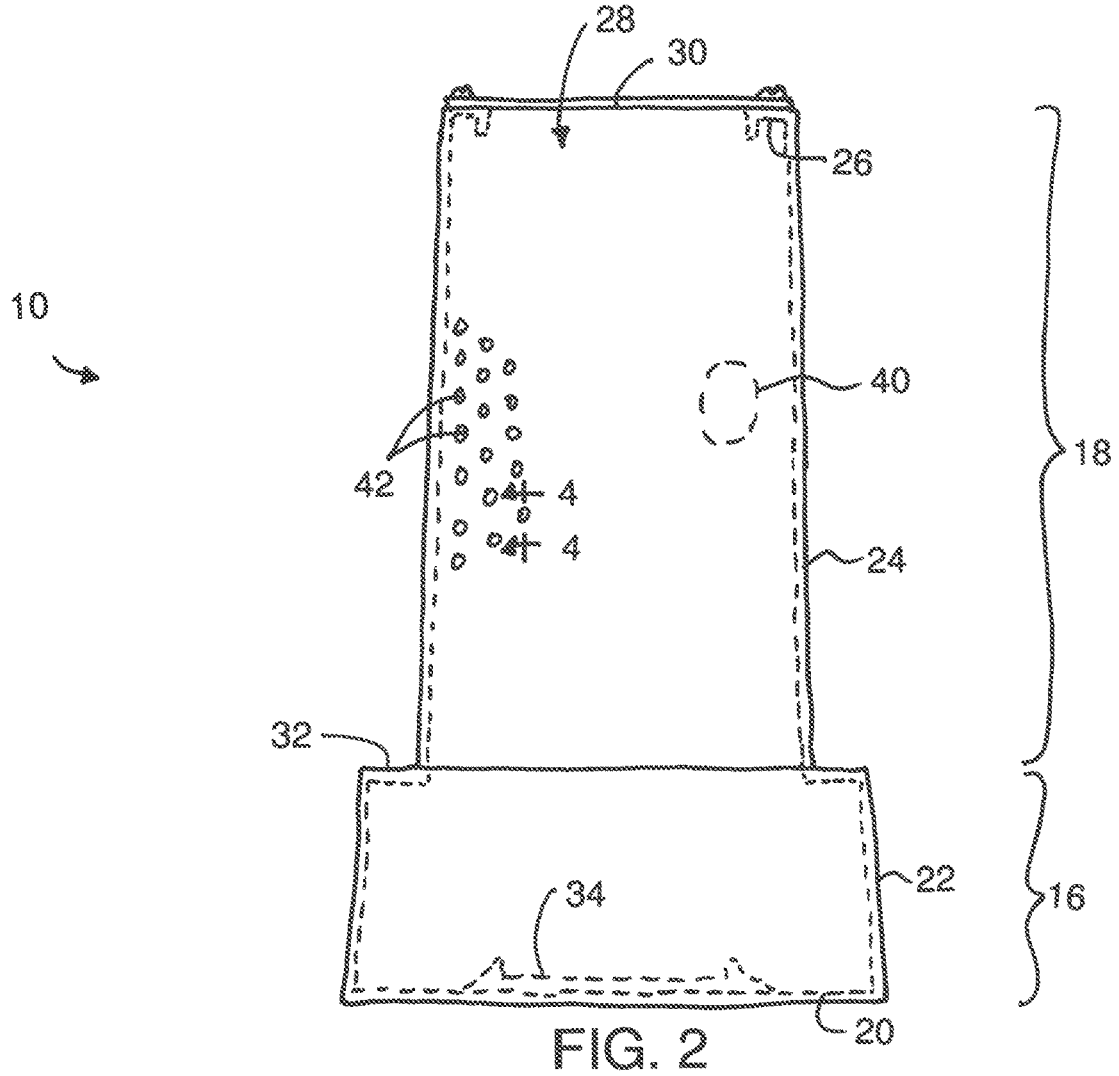
FIG. 2 is an elevational view of the collection tank according to FIG. 1 with the cover plate enclosing the top end of the tank.
Figure 3:
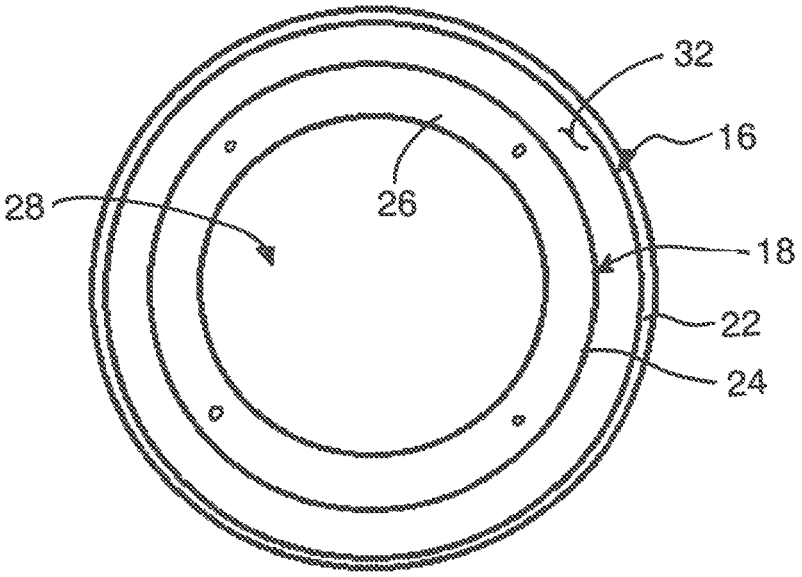
FIG. 3 is a top plan view of the collection tank according to FIG. 1 with the cover plate shown removed.
Figure 4:
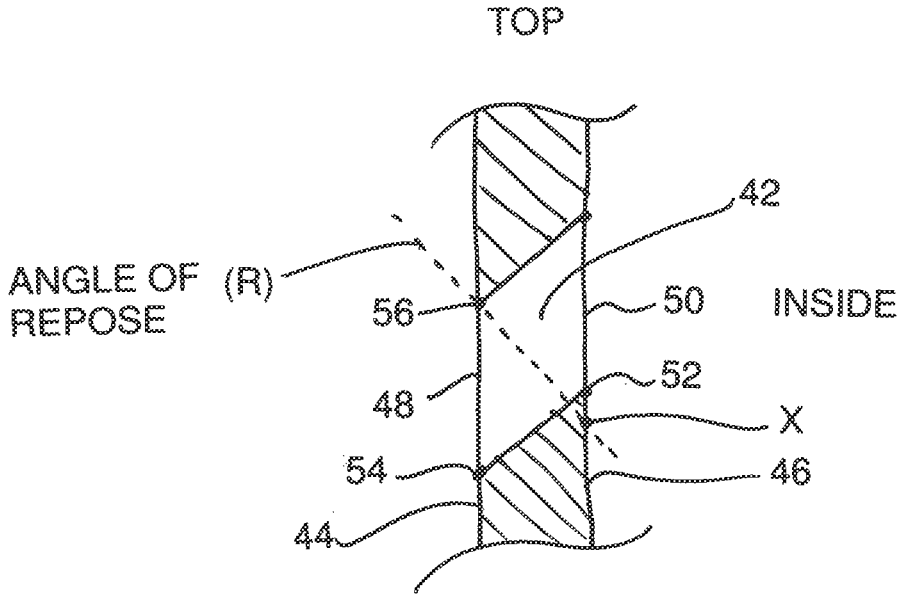
FIG. 4 is a sectional view along the line 4-4 in FIG. 2.

Referring to the accompanying figures there is illustrated a collection tank generally indicated by reference numeral 10. The collection tank is particularly suited for use below the floor 12 of a building. The collection tank is typically surrounded with a granular aggregate material 14 such as gravel that occupies a space below the floor of the building.

Although two embodiments of the collection tank are illustrated in the accompanying figures, the features in common with both embodiments will first be described herein.

In each instance the collection tank 10 comprises a tank body having a lower tank portion 16 forming the bottom of the tank 10 and an upper tank portion 18 forming the top of the collection tank. The lower tank portion has a hollow interior which is open at the top end thereof. The upper tank portion 18 includes a similar hollow interior, but is open at the bottom and so that the upper and lower tank portions openly communicate with one another and define a common hollow interior of the tank body.

The lower tank portion 16 includes a bottom wall 20 which is generally horizontally oriented in a mounted configuration and which is typically circular in shape for forming the lower boundary of the collection tank. The lower tank portion also includes an outer wall 22 which is upstanding from a perimeter of the bottom wall to fully surround the hollow interior of the lower tank portion. The outer wall 22 of the lower tank portion is generally cylindrical or frustoconical in shape so as to taper upwardly and inwardly from the bottom to the top according to the illustrated embodiment.

The upper tank portion 18 also includes an outer wall 24 which is generally cylindrical or frustoconical in shape between opposing top and bottom ends of the upper tank portion. The bottom edge of the outer wall 24 of the upper tank portion which defines the bottom end of the upper tank portion is connected to the open top end of the lower tank portion 16 in the assembled configuration of the tank body. The upper tank portion 18 also includes a top flange 26 in the form of an annular flange lying in a horizontal plane at the top end of the outer wall 24 of the upper tank portion to extend radially inward therefrom about a perimeter of a top opening 28 which occupies the majority of the top end of the upper tank portion.

A cover plate 30 the form of a round rigid plate is arranged to span the top end of the upper tank portion in overlapping arrangement with the top flange 26 about the full perimeter thereof for enclosing the top opening 28 of the tank body. Fastener apertures are provided at cooperating locations in the cover plate and the top flange to receive suitable fasteners for selectively and removably mounting the cover plate onto the top of the tank body.

A shoulder 32 extends radially inward from the top end of the lower tank portion to the bottom edge of the upper tank portion to span the radial distance between the larger outer diameter of the top end of the lower tank portion 16 relative to the smaller outer diameter of the bottom edge of the upper tank portion 18 connected thereto.

The bottom wall 20 of the lower tank portion is formed to include a raised platform 34 therein which serves as a suitable support for a sump pump 36 received thereon in a mounted position of the collection tank below the floor of a building. The sump pump 36 is inserted into the assembled tank body through the top opening 28 in the upper tank portion prior to mounting of the cover plate 30 onto the tank body. A discharge hose 38 is connected to the sump pump and communicates through a respective opening in the cover plate so that the sump pump is configured to pump water collected in the bottom of the collection tank 10 upwardly through the discharge hose 38 for discharging to a separate discharge location away from the building.

The tank body is typically perforated as described in further detail below such that groundwater surrounding the collection tank can weep through perforations in the collection tank for subsequent collection within the lower tank portion of the collection tank so that the collected water can be pumped away by the sump pump. The collection tank may also include one or more pipe openings 40 formed in the outer wall of the upper tank portion 18 to receive weeping tile or other suitable drainage pipe communicating therethrough for directing collected groundwater from other locations of the building into the interior of the collection tank 10.

The lower tank portion is typically imperforate and devoid of any perforations or holes such that the outer wall 22 and the bottom wall 22 which are connected collectively define a suitable container or receptacle capable of containing and collecting water therein to be pumped away by the sump pump. The outer wall 24 of the upper tank portion is perforated by an array of drain holes 42 formed in the outer wall to substantially cover the entirety of the outer wall of the upper tank portion.

Each drain hole 42 comprises a cylindrical bore extending through the outer wall from an exterior surface 44 of the tank wall to an interior surface 46 of the tank wall at an upward and inward slope. More particularly the axis of the bore is inclined upwardly and inwardly at a preferred inclination of 45 degrees from horizontal or within a preferred range of 45 to 50 degrees from horizontal. An upward and inward inclination of the axis of each drain hole in the range of 35 to 55 degrees may also be effective.

Each drain hole includes an outer perimeter edge 48 located at the intersection of the bore through the outer wall with the exterior surface 44 and an inner perimeter edge 50 located at the intersection of the bore through the outer wall with the interior surface 46. The outer wall typically has a radial thickness from the exterior surface 44 to the interior surface 46 thereof which is between 0.1 and 0.2 inches. The diameter of the bore forming each drain hole is typically between ¼ and ⅜ of an inch.

Overall each drain hole 42 is typically arranged so that the bottom 52 at the lowermost portion of the inner perimeter edge 50 is located above or at greater elevation than the bottom 54 at the lowermost portion of the outer perimeter edge 48. The lower boundary surface of each drain hole is thus ramped upwardly and inwardly from the outer perimeter edge to the inner perimeter edge to discourage aggregate particles falling through the drain holes 42 from the exterior into the interior of the collection tank.

In a preferred arrangement, the bottom 52 of the inner perimeter edge 50 is near in elevation to the top 56 at the uppermost portion of the outer perimeter edge 48. In the resulting arrangement, an angle of repose R of material deposited about the collection tank which extends from the top 56 of the outer perimeter edge of each hole intersects the interior surface 46 at a location X which is lower in elevation than the bottom 52 of the inner perimeter edge 50 to further ensure that aggregate material deposited about the exterior of the collection tank does not readily spill through the drainage holes even when the average particle size of the aggregate material is less than the bore diameter of each drain hole.

Turning now more particularly to the embodiment shown in FIGS. 1 through 4, in this instance the upper tank portion 18 and the lower tank portion 16 comprise a singular, unitary body of material. With the exception of the configuration of the drain holes, the tank body in this instance is substantially identical to the collection tank described in U.S. Pat. No. 5,727,901 by Rennie et al., the disclosure of which is incorporated herein by reference.

Figure 5:
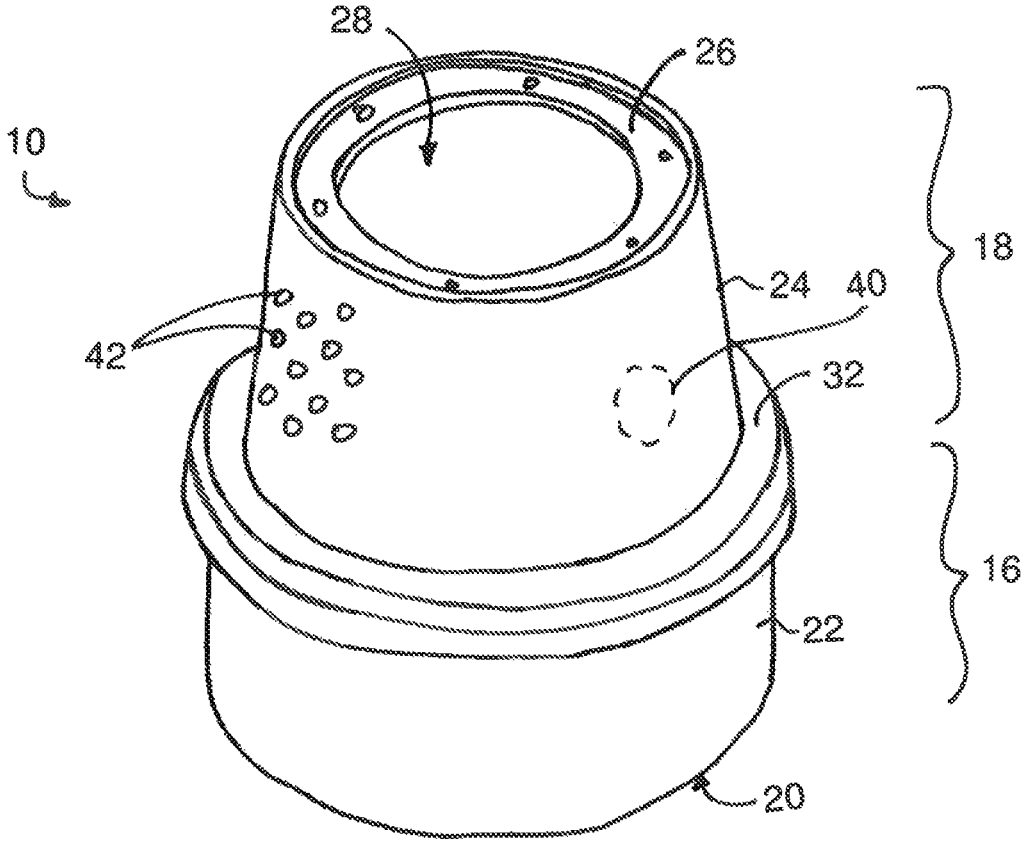
FIG. 5 is a perspective view of a second embodiment of the collection tank in which a sectional view through one of the drainage apertures in the tank is similar to the sectional view of FIG. 4.

Turning now more particularly to the embodiment shown in FIG. 5, in this instance the upper tank portion 18 is readily separable from the lower tank portion 16 so that the collection tank is more readily collapsed for shipping and storage.

Figure 7:
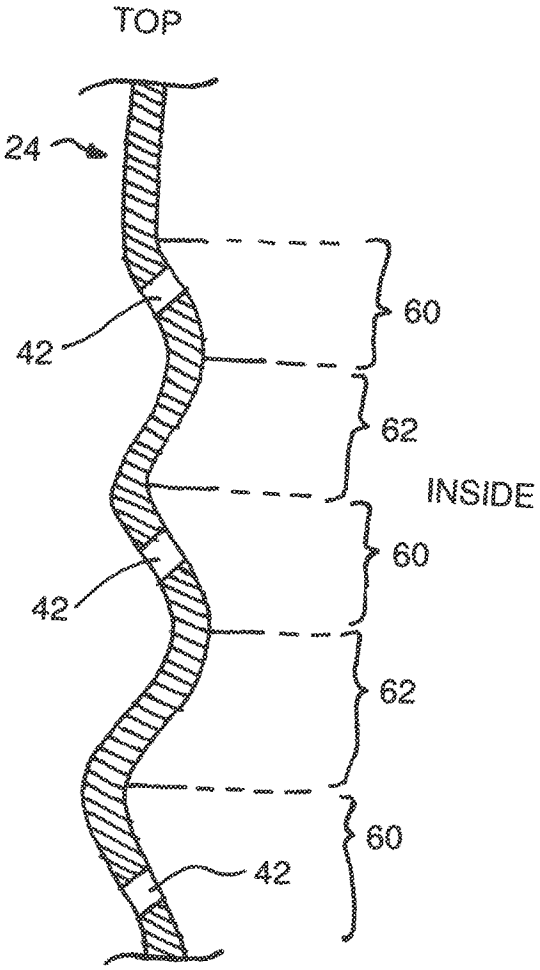
FIG. 7 is a sectional view of a portion of the outer wall of the upper tank portion according to the third embodiment of FIG. 6.
Figure 6:
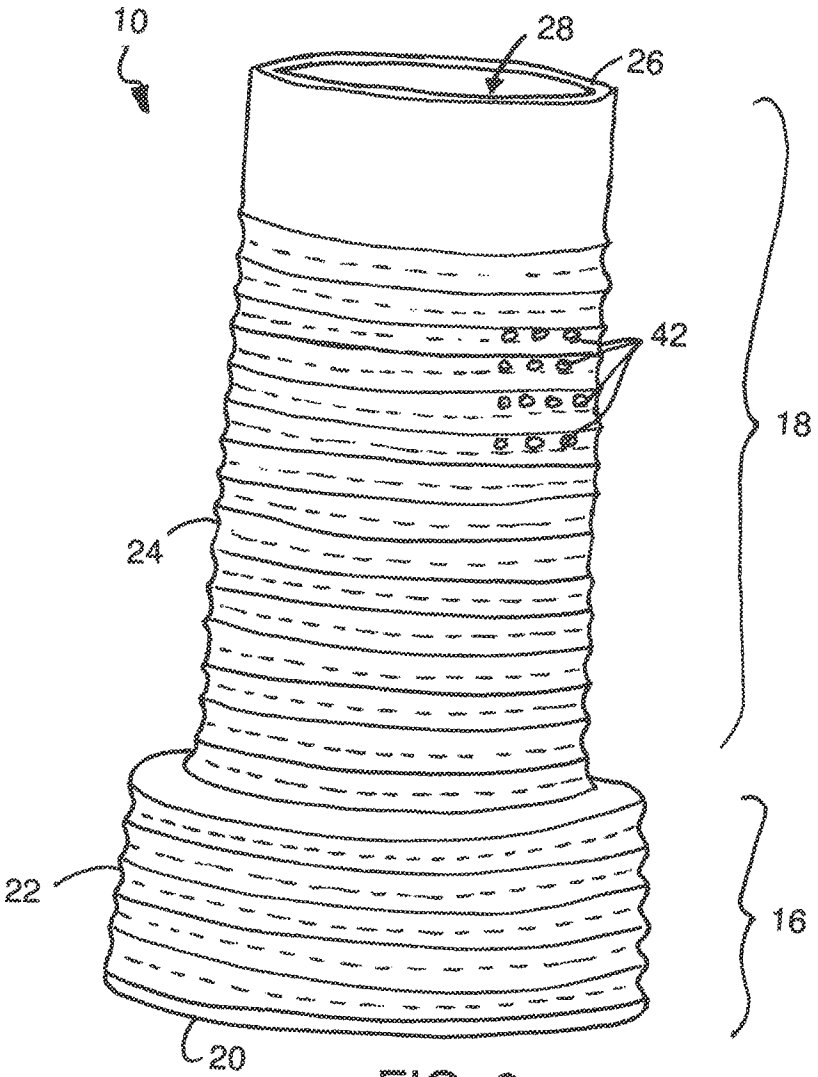
FIG. 6 is a perspective view of a third embodiment of the collection tank.

Turning now more particularly to the embodiment shown in FIGS. 6 and 7, in this instance the outer wall 24 of the upper tank portion 18 and the outer wall 22 of the lower tank portion 16 may each be corrugated. Accordingly, the outer wall 24 includes a plurality of first annular wall portions 60 extending at an upward and radially outward slope and a plurality of second annular wall portions 62 extending at an upward and radially inward slope. Each second annular wall portion 62 is located between a corresponding pair of the first annular wall portions 60 along a height of the upper tank portion. The holes 42 in the upper tank portion are located in the first annular wall portions 60 so as to be sloped upwardly and inwardly similarly to the previous embodiments.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A collection tank for mounting under a floor of a building for collecting ground water from an area under the floor to be pumped away by a pump, the collection tank comprising:

a tank body including a lower tank portion and an upper tank portion;

the lower tank portion having a bottom wall and an outer wall upstanding from the bottom wall, the outer wall and the bottom wall of the lower tank portion defining a container for collected water with an open top;

the upper tank portion having a bottom edge connected to the lower tank portion at the open top and having an outer wall upstanding from the open top, the outer wall of the upper tank portion being perforated with holes arranged in an array extending around a full periphery of the outer wall of the upper tank portion for passage of ground water through the array of holes into the tank body;

the upper tank portion having an open bottom for communication of the ground water into the lower reservoir portion;

the lower tank portion being arranged to receive the pump so as to pump water from the lower tank portion at a position below the open top of the lower tank portion and below the holes in the upper tank portion;

each of the holes extending radially through the outer wall of the upper tank portion from an outer perimeter edge at an intersection of the hole with an outer surface of the outer wall at an exterior of the tank body to an inner perimeter edge at an intersection of the hole with an inner surface of the outer wall at an interior of the tank body; and each of the holes having a lowermost portion of the inner perimeter edge of the hole being at a greater height from the bottom wall than a lowermost portion of the outer perimeter edge of the hole;

the outer wall of the upper tank portion being corrugated so to comprise a plurality of first annular wall portions extending at an upward and radially outward slope and a plurality of second annular wall portions extending at an upward and radially inward slope;

each second annular wall portion being located between a corresponding pair of the first annular wall portions along a height of the upper tank portion; and the holes in the upper tank portion being located in the first annular wall portions.

2. The collection tank according to claim 1 wherein each hole is arranged such that the lowermost portion of the inner perimeter edge of the hole is at a greater height from the bottom wall than an intersection of an angle of repose of a granular material extending from an uppermost edge of the outer perimeter edge of the hole with the inner surface of the outer wall.

3. The collection tank according to claim 2 in combination with the granular material having an average particle size that is smaller than a diameter of the holes.

4. The collection tank according to claim 1 wherein each hole has a hole diameter that is between ¼ inch and ⅜ inch.

5. The collection tank according to claim 1 wherein the outer wall of the upper tank portion has a wall thickness that is 0.1 and 0.2 inches.

6. The collection tank according to claim 1 wherein each hole extends radially inward from the outer surface of the outer wall to the inner surface of the outer wall at an upward inclination.

7. The collection tank according to claim 6 wherein the upward inclination is at least 35 degrees from horizontal.

8. The collection tank according to claim 6 wherein the upward inclination is at least 45 degree from horizontal.

9. The collection tank according to claim 6 wherein the upward inclination is less than 55 degrees from horizontal.

10. The collection tank according to claim 6 wherein the upward inclination is less than 50 degrees from horizontal.

11. The collection tank according to claim 6 wherein the upward inclination is between 45 and 50 degrees from horizontal.

12. A collection tank for mounting under a floor of a building for collecting ground water from an area under the floor to be pumped away by a pump, the collection tank comprising:

a tank body including a lower tank portion and an upper tank portion;

the lower tank portion having a bottom wall and an outer wall upstanding from the bottom wall, the outer wall and the bottom wall of the lower tank portion defining a container for collected water with an open top;

the upper tank portion having a bottom edge connected to the lower tank portion at the open top and having an outer wall upstanding from the open top, the outer wall of the upper tank portion being perforated with holes arranged in an array extending around a full periphery of the outer wall of the upper tank portion for passage of ground water through the array of holes into the tank body;

the upper tank portion having an open bottom for communication of the ground water into the lower reservoir portion;

the lower tank portion being arranged to receive the pump so as to pump water from the lower tank portion at a position below the open top of the lower tank portion and below the holes in the upper tank portion;

each of the holes extending radially through the outer wall of the upper tank portion from an outer perimeter edge at an intersection of the hole with an outer surface of the outer wall at an exterior of the tank body to an inner perimeter edge at an intersection of the hole with an inner surface of the outer wall at an interior of the tank body; and each of the holes having a lowermost portion of the inner perimeter edge of the hole being at a greater height from the bottom wall than a lowermost portion of the outer perimeter edge of the hole;

each hole having a hole diameter that is between ¼ inch and ⅜ inch;

the outer wall of the upper tank portion having a wall thickness that is 0.1 and 0.2 inches; and the upward inclination being at least 45 degree from horizontal and less than 55 degrees from horizontal.

13. The collection tank according to claim 12 in combination with the granular material, the granular material having an average particle size that is smaller than a diameter of the holes.

* * * * *